US007358842B1

(12) United States Patent
Liu

(10) Patent No.: US 7,358,842 B1
(45) Date of Patent: Apr. 15, 2008

(54) WIRE-WINDING COMMON MODE CHOKE

(75) Inventor: Chun-Yi Liu, Taipei Hsien (TW)

(73) Assignee: Prosperity Dielectrics Co., Ltd., Taipei Hsien (TW)

( * ) Notice: Subject to any disclaimer, the term of this patent is extended or adjusted under 35 U.S.C. 154(b) by 0 days.

(21) Appl. No.: 11/594,412

(22) Filed: Nov. 8, 2006

(51) Int. Cl.
*H01F 27/02* (2006.01)
*H01F 5/00* (2006.01)

(52) U.S. Cl. ..... 336/83; 336/65; 336/200

(58) Field of Classification Search ..... 336/223, 336/200, 232, 83, 65
See application file for complete search history.

(56) References Cited

U.S. PATENT DOCUMENTS 6,335,095 B1 * 1/2002 Sugimoto et al. ..... 428/402
6,522,230 B2 * 2/2003 Hanato et al. ..... 336/83
6,778,055 B1 * 8/2004 Wang ..... 336/83
7,078,988 B2 * 7/2006 Suzuki et al. ..... 333/181
7,241,093 B2 * 7/2007 Zuniga ..... 410/97
7,256,673 B2 * 8/2007 Okumura et al. ..... 336/83

* cited by examiner

*Primary Examiner*—Anh Mai
(74) *Attorney, Agent, or Firm*—Alan Kamrath; Kamrath & Associates PA

(57) ABSTRACT

A wire-winding common mode choke has a body, a first coil and a second coil. The body has two channels respectively defined in two lateral sides of the body and at least two steps. Each step has a first folding end and a second folding end. The first and second coils are wired around the channels of the body and respectively across the first or second folding ends of the corresponding steps. When the first and the second coils are respectively weld by heating, there is no short circuit between the first and the second coils because the steps separate the first and second coils.

2 Claims, 9 Drawing Sheets

WIRE-WINDING COMMON MODE CHOKE

BACKGROUND OF THE INVENTION

1. Field of the Invention

The present invention relates to a wire-winding common mode choke, and more particularly to a wire-winding common mode choke that can prevent the wire from interconnecting.

2. Description of the Related Art

The electrical appliances generate an electromagnet wave intervening the operation of the electrical appliances. To hedge the intervention of the electromagnet wave, a conventional wire-winding common mode choke is mounted in the electrical appliances.

With reference to FIGS. 7 and 8, the conventional wire-winding common mode choke has a body (50), two initial welding points (51) and two ending welding points (52) respectively formed in four corners of the body (50), two channels (53) respectively defined in two lateral sides of the body (50), four folding portions (54) respectively formed in two edges of each channel (53), and a first and a second coil (60, 61).

With further reference to FIG. 9, the first and second coil (60, 61) are welded respectively at the initial welding points (51), are mounted around the channels (53) across a folding portion (54) near one of the initial welding points (51) and are welded respectively at the ending welding points (52). The first coil (60) is easy to interconnect to the second coil (61) at the folding portion (54). The interconnection portion is likely to short circuit without preventing the noise. Therefore, the invention provides an improved wire-winding common mode choke to mitigate or obviate the aforementioned problems.

SUMMARY OF THE INVENTION

The main objective of the present invention is to provide a wire-winding common mode choke that can prevent the intervention of the electromagnetic wave.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
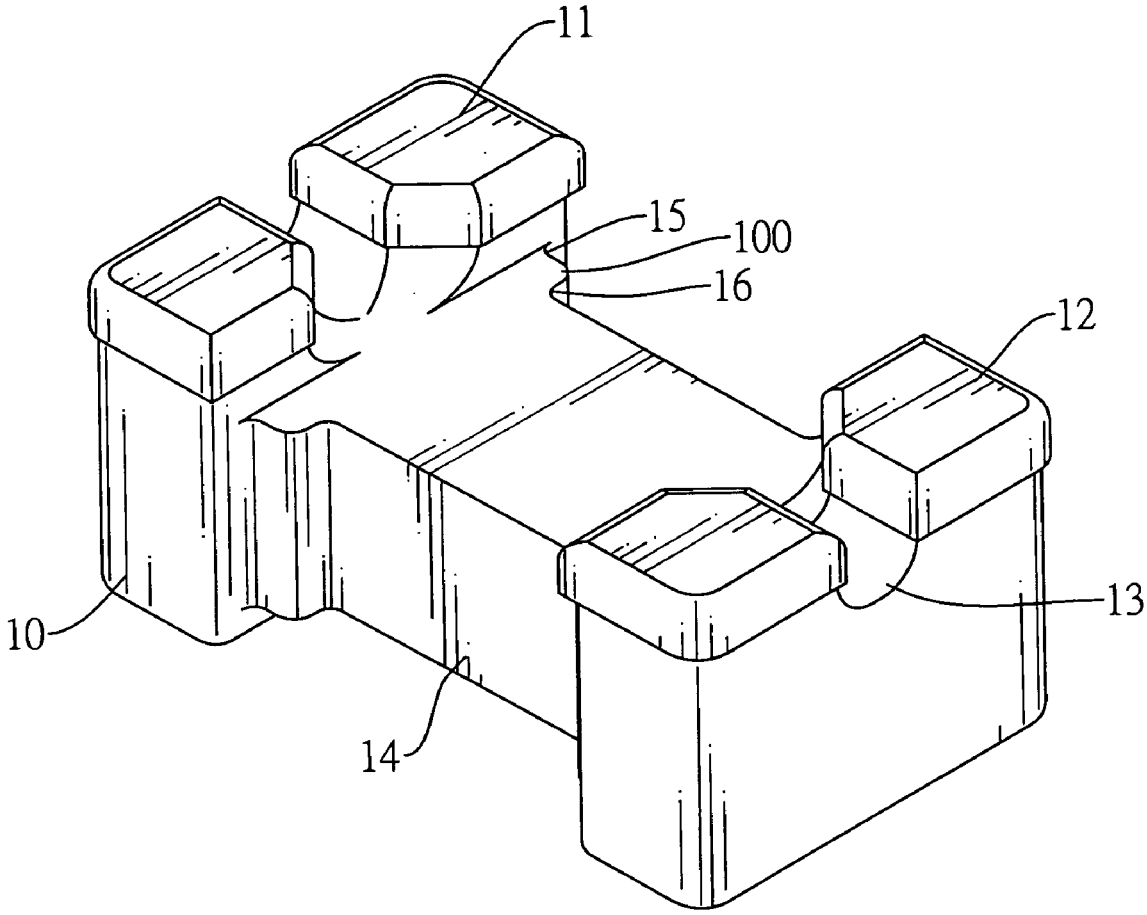
FIG. 1 is a perspective view of a body of a first preferred embodiment of a wire-winding common mode choke in accordance with the present invention.

With reference to FIG. 1, a first preferred embodiment of a wire-winding common mode choke in accordance with the present invention has a body (10), a first coil (20) and a second coil (21).

The body (10) has two initial welding points (11) and two ending welding points (12), two gaps (13), two channels (14) and four steps (100). The initial welding points (11) and the ending welding points (12) are respectively formed on four corners on a surface of the body (10). The ending welding points (12) are respectively opposite to the initial welding points (11). The gaps (13) are defined respectively between the initial welding points (11) and the ending welding points (12). The channels (14) are defined respectively in two lateral sides of the body (10). The steps (100) are formed respectively between the channels (14) and the initial and ending welding points (11, 12). Each step (100) has a first folding end (15) and a second folding end (16). The first folding ends (15) of the steps (100) are formed adjacent to the initial or ending welding points (11, 12). The second folding ends (16) of the steps (100) are formed adjacent to the channels (14).

Figure 2:
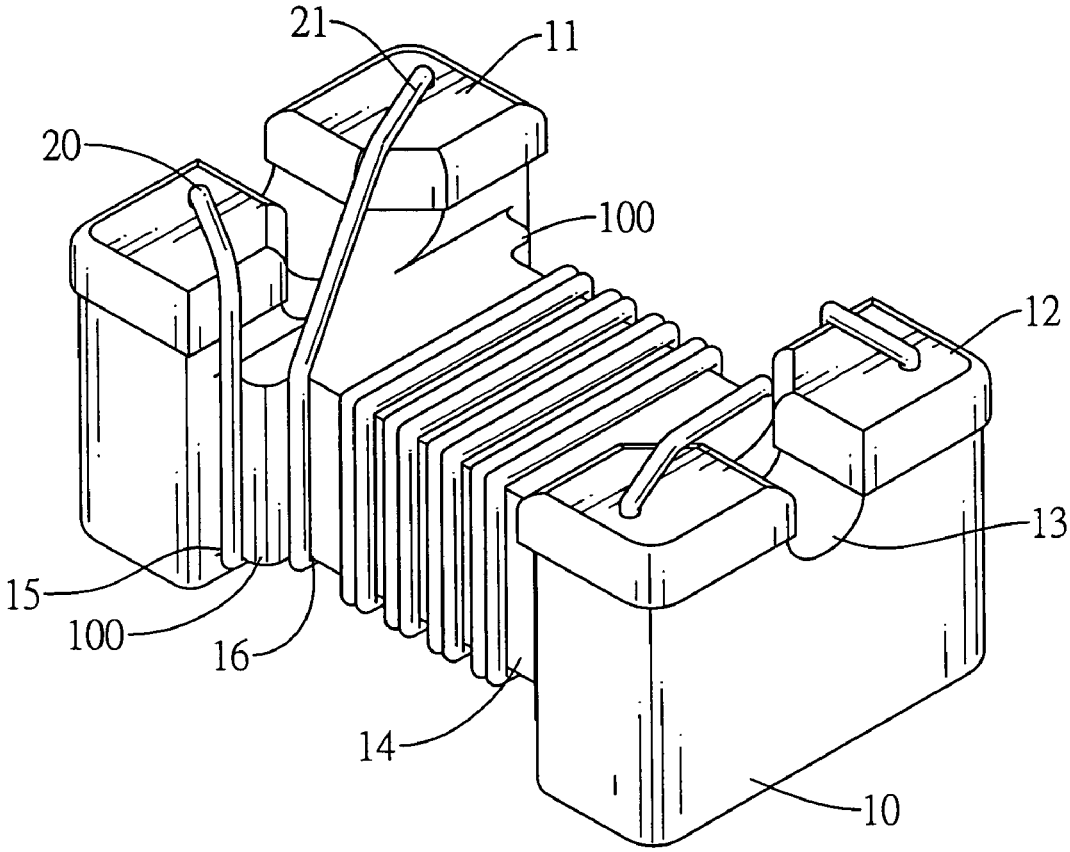
FIG. 2 is a perspective view of the first preferred embodiment of the wire-winding common mode choke in FIG. 1.
Figure 3:
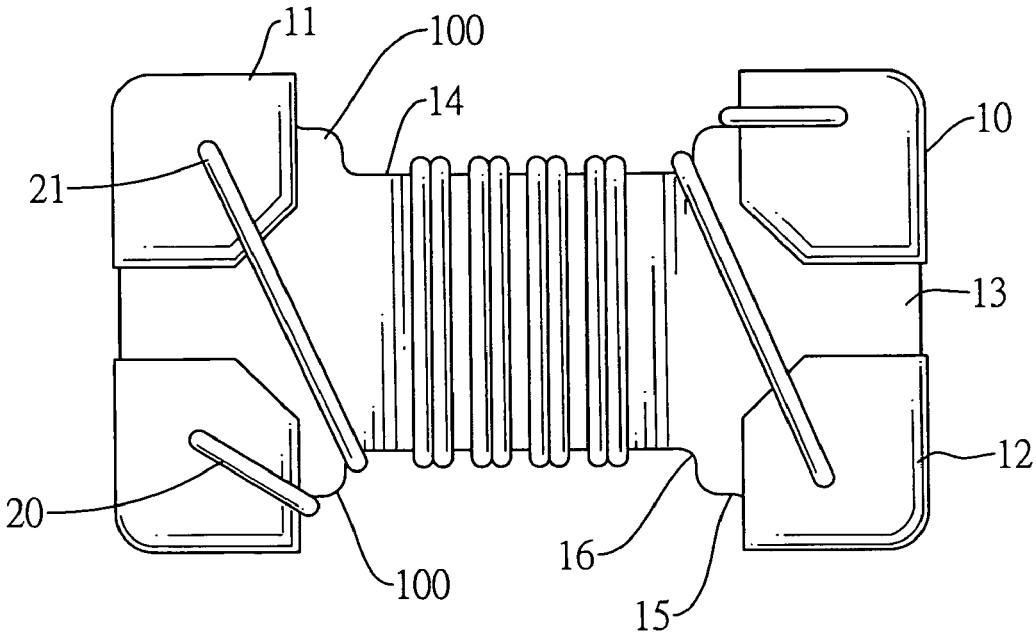
FIG. 3 is a top view of the first preferred embodiment of the wire-winding common mode choke in FIG. 1.

With further reference to FIGS. 2 and 3, the first and second coils (20, 21) are wired respectively around the channels (14) in the body (10). Each coil (20, 21) has a starting end and a final end. The starting ends of the first and the second coils (20, 21) respectively connect to the initial welding points (11) and are respectively across the first and second folding ends (15, 16) of one of the steps (100) on the body (10). The final ends of the first and second coils (20, 21) respectively connect to the ending welding points (12) and are respectively across the first and second folding ends (15, 16) of another one of the steps (100) on the body (10). When the first and the second coil (20, 21) are respectively weld by heating, there is no short circuit between the first and the second coil (20, 21) because the steps (100) separate the starting and final ends of the first and second coils (20, 21).

Figure 4:
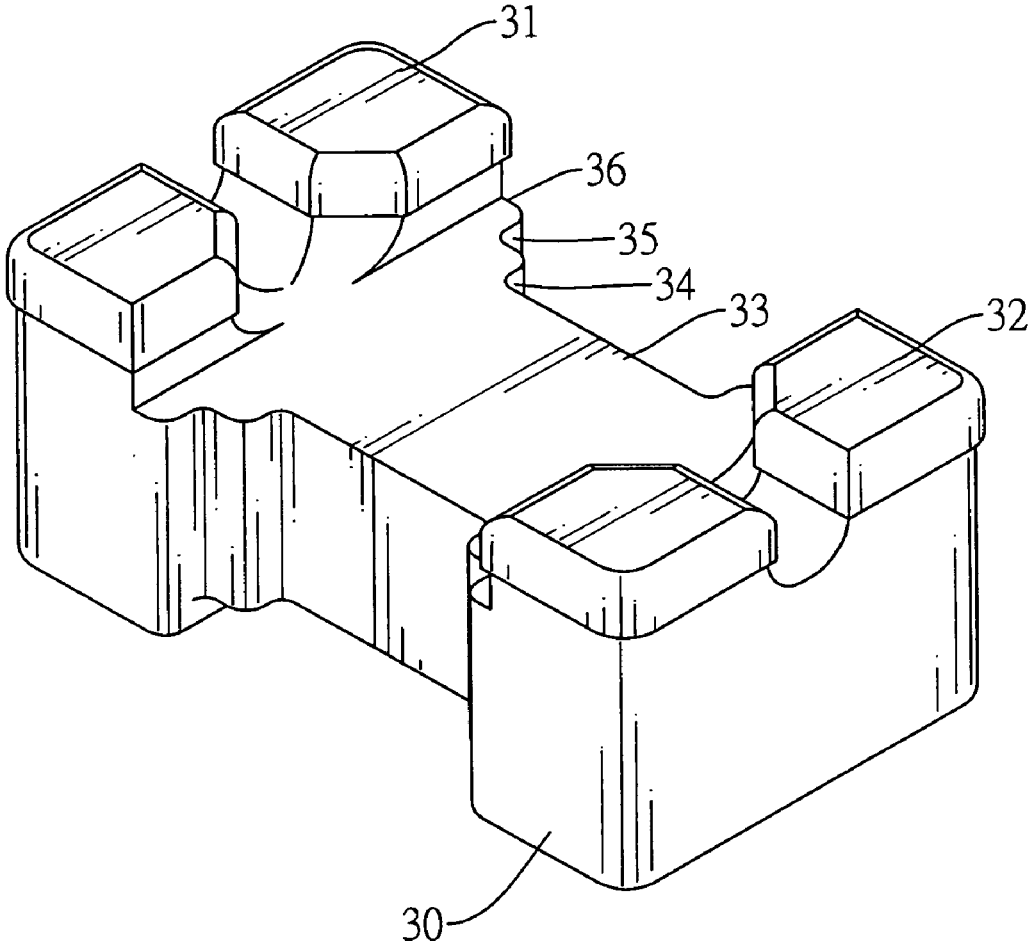
FIG. 4 is a perspective view of a body of a second preferred embodiment of a wire-winding common mode choke in accordance with the present invention.
Figure 5:
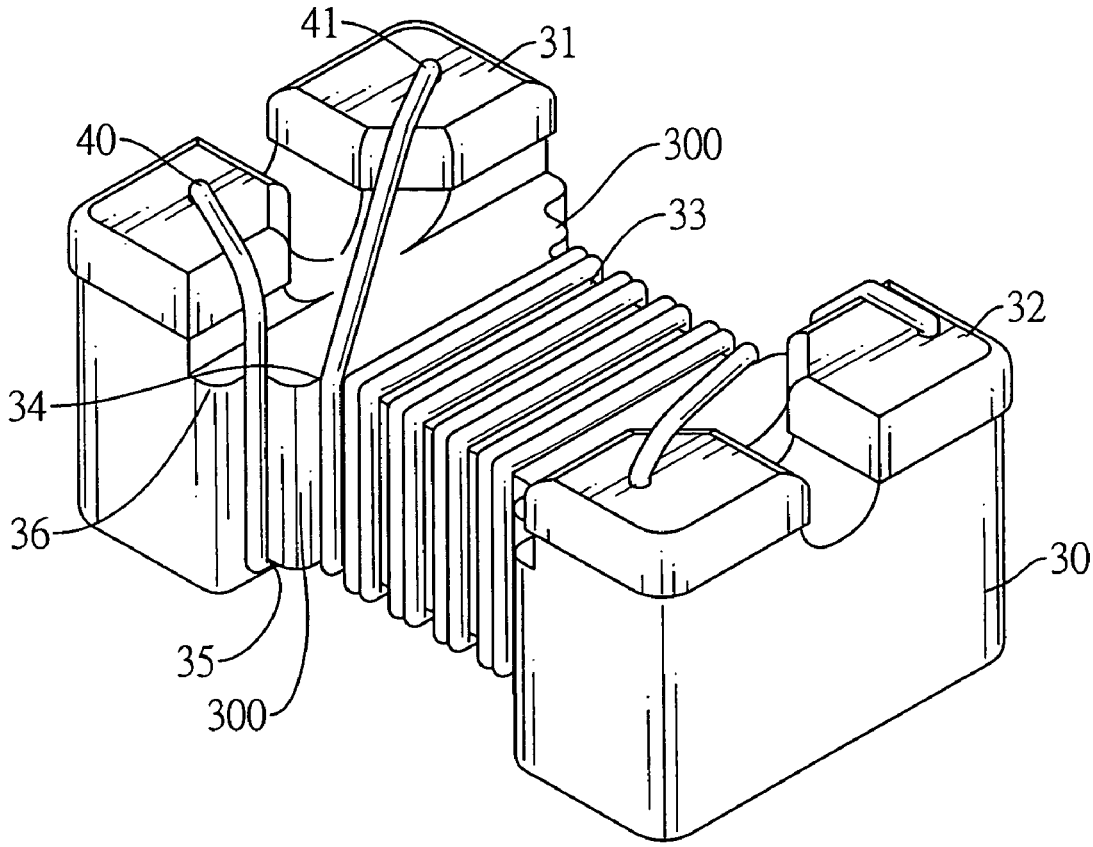
FIG. 5 is a perspective view of the second preferred embodiment of the wire-winding common mode choke in FIG. 4.
Figure 6:
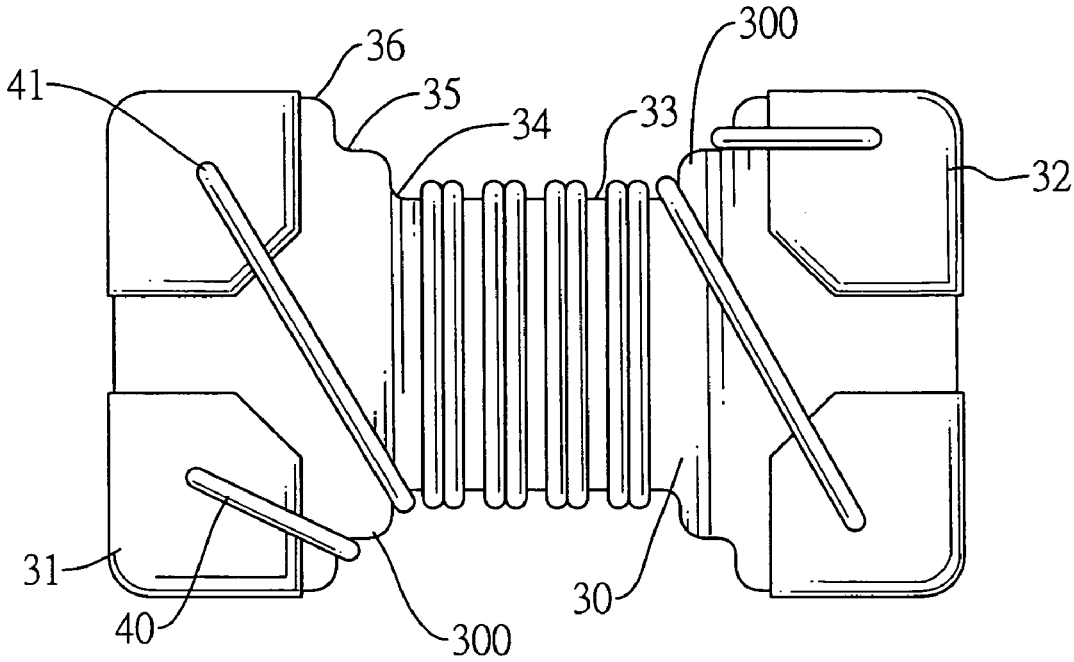
FIG. 6 is a top view of the second preferred embodiment of the wire-winding common mode choke in FIG. 4.
Figure 7:
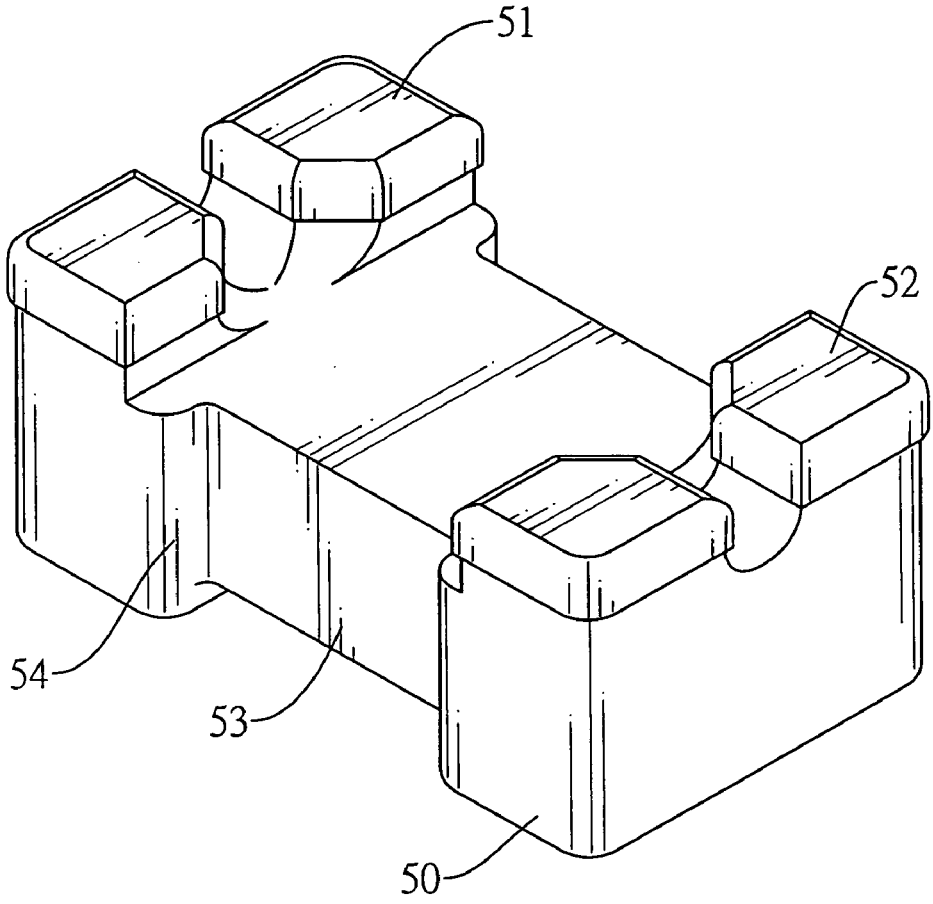
FIG.7 PRIOR ART
FIG. 7 is a perspective view of a body of a conventional wire-winding common mode choke.
Figure 8:
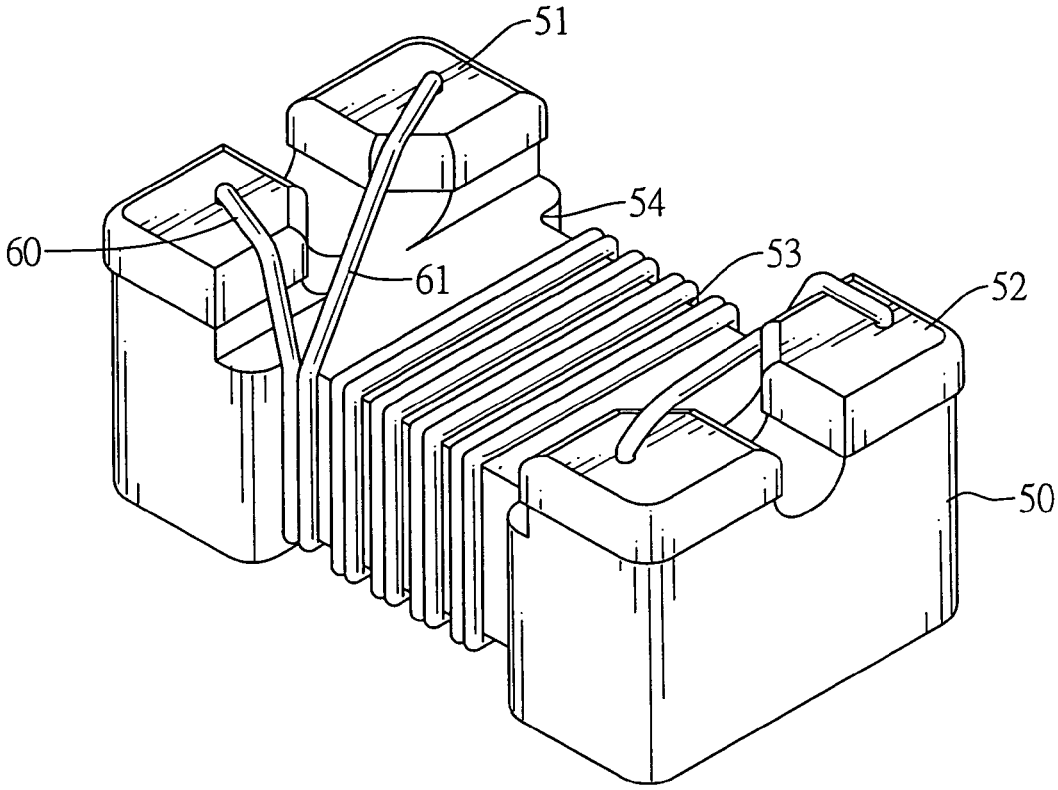
FIG.8 PRIOR ART
FIG. 8 is a perspective view of the conventional wire-winding common mode choke.
Figure 9:
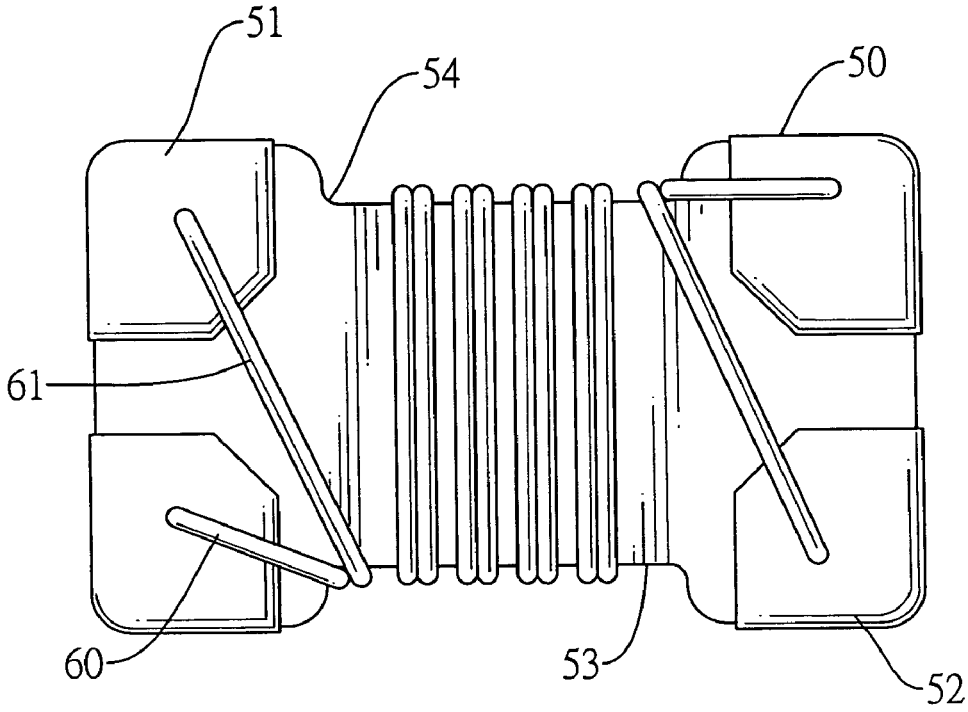
FIG.9 PRIOR ART
FIG. 9 is a top view of the conventional wire-winding common mode choke.

With reference to FIGS. 4 to 6, a second preferred embodiment of the present invention is similar to the first preferred embodiment except that an extending step (36) is formed between each first folding end (35) and each initial or ending welding point (31, 32). The starting ends of the first and the second coils (40, 41) respectively connect to the initial welding points (31) and are respectively across the first and second folding ends (35, 36) of one of the steps (300) on the body (30). The final ends of the first and second coils (40, 41) respectively connect to the ending welding points (32) and are respectively across the first and second folding ends (35, 36) of another one of the steps (300) on the body (30). When the first and the second coils (40, 41) are respectively welded, there is no short circuit between the first and the second coils (40, 41) because the steps (300) separate the starting and final ends of the first and second coils (40, 41).

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A wire-winding common mode choke comprising:

a body having two initial welding points and two ending welding points respectively formed on four corners of a surface of the body;

two channels respectively defined in two lateral sides of the body; and at least two steps formed respectively between the channels and the initial and ending welding points, and each one of the at least two steps having a first folding end formed adjacent to a corresponding welding point; and a second folding end formed adjacent to a corresponding channel;

a first coil wired around the channels in the body and having a starting end connecting to a corresponding initial welding point across a corresponding first folding end of a corresponding step; and a final end connecting to a corresponding ending welding point across a corresponding first folding end of a corresponding step; and a second coil wired around the channels in the body and having a starting end connecting to a corresponding initial welding point across a corresponding second folding end of a corresponding step; and a final end connecting to a corresponding ending welding point across a corresponding second folding end of a corresponding step.

2. The wire-winding common mode choke as claimed in claim 1, wherein an extending step is formed between each first folding end and the welding points.

* * * * *